US008643447B2

(12) United States Patent
Chen et al.

(10) Patent No.: US 8,643,447 B2
(45) Date of Patent: Feb. 4, 2014

(54) TERMINAL CIRCUIT AND BI-DIRECTIONAL COUPLER USING THE TERMINAL CIRCUIT

(75) Inventors: Yu-Sheng Chen, New Taipei (TW); Chun-Jui Pan, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 362 days.

(21) Appl. No.: 13/077,902

(22) Filed: Mar. 31, 2011

(65) Prior Publication Data

US 2012/0182085 A1 Jul. 19, 2012

(30) Foreign Application Priority Data

Jan. 17, 2011 (CN) ..... 2011 1 0009243

(51) Int. Cl.
*H01P 5/12* (2006.01)
*H01P 5/18* (2006.01)

(52) U.S. Cl.
USPC ..... 333/109; 333/116

(58) Field of Classification Search
USPC ..... 333/109, 110, 112, 115, 116, 238
See application file for complete search history.

(56) References Cited

U.S. PATENT DOCUMENTS 5,006,821 A * 4/1991 Tam ..... 333/116
5,424,694 A * 6/1995 Maloratsky et al. ..... 333/112
2005/0212617 A1* 9/2005 Chen ..... 333/116

* cited by examiner

*Primary Examiner* — Dean O Takaoka
(74) *Attorney, Agent, or Firm* — Altis Law Group, Inc.

(57) ABSTRACT

A terminal circuit is applied to a bi-directional coupler. The terminal circuit includes a transmission line having a first end and a second end, a first resistor connecting the first end and a first ground and a second resistor connecting the second end and a second ground. A resistance value of the first resistor is substantially identical to that of the second resistor.

2 Claims, 6 Drawing Sheets

TERMINAL CIRCUIT AND BI-DIRECTIONAL COUPLER USING THE TERMINAL CIRCUIT

BACKGROUND

1. Technical Field

The present disclosure relates to a bi-directional coupler, and more particularly to a bi-directional coupler using an improved terminal circuit.

2. Description of Related Art

A directional coupler is a radio frequency (RF) component/device which provides three communication ports, an input port, an output port and a coupled port. RF signals enter the directional coupler via the input port, where only a small portion thereof is output via the coupled port while the remaining is output via the output port.

FIG. 5 shows a schematic view of one such bi-directional coupler 100. The bi-directional 100 provides 4 communication ports: an input port 110, an output port 120, a coupled port 130 and an isolated port 140. The bi-directional coupler 100 further provides two terminal circuits 150 and 160 which respectively comprise terminal resistors 155 and 165, each connecting to a ground. The resistance value of each of the resistors 155 and 165 is 50 ohm (Ω), in one example.

FIG. 6 shows a schematic view of an equivalent circuit of the bi-directional coupler 100 shown in FIG. 1. When a transmitter (TX) 170 delivers RF signals to the bi-directional coupler 100 via the input port 110, a large portion of the RF signals are forwarded to an antenna 180 via the output port 120. Meanwhile, a lesser portion of the RF signals are transmitted to the coupled port 130 while no RF signal is output via the isolated port 140 (in an ideal manner). On the contrary, when RF signals are delivered to the bi-directional coupler 100 via the output port 120, a large portion of the RF signals are forwarded to the transmitter 170 via the input port 110. Meanwhile, a lesser portion of the RF signals is transmitted to the isolated port 140 while no RF signal is output via the coupled port 130 (in an ideal manner).

However, accuracy of termination values of a terminal resistor may be affected due to manufacturing processes and temperature variations and parasitical effects of parasitical capacitors, thereby increasing return loss and diminishing isolation of a coupler. In other words, referring to FIG. 2, the terminal resistor 165 of the terminal circuit 160 involves an allowed tolerance range so that signal transmission may be impeded due to variations of a resistance value of the terminal circuit 160.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

An embodiment of a bi-directional coupler of the present disclosure uses improved terminal circuits to reduce return loss and enhance isolation for resistors and achieve high directivity of the bi-directional coupler. In other words, two terminal resistors, which are separated by a transmission line replace a terminal resistor residing in a conventional terminal circuit. Therefore, resistance tolerance influence caused by manufacturing processes and temperature variations and parasitical effect influence from parasitical capacitors is minimized, thereby enhancing accuracy of terminal circuits of the bi-directional coupler.

Figure 1:
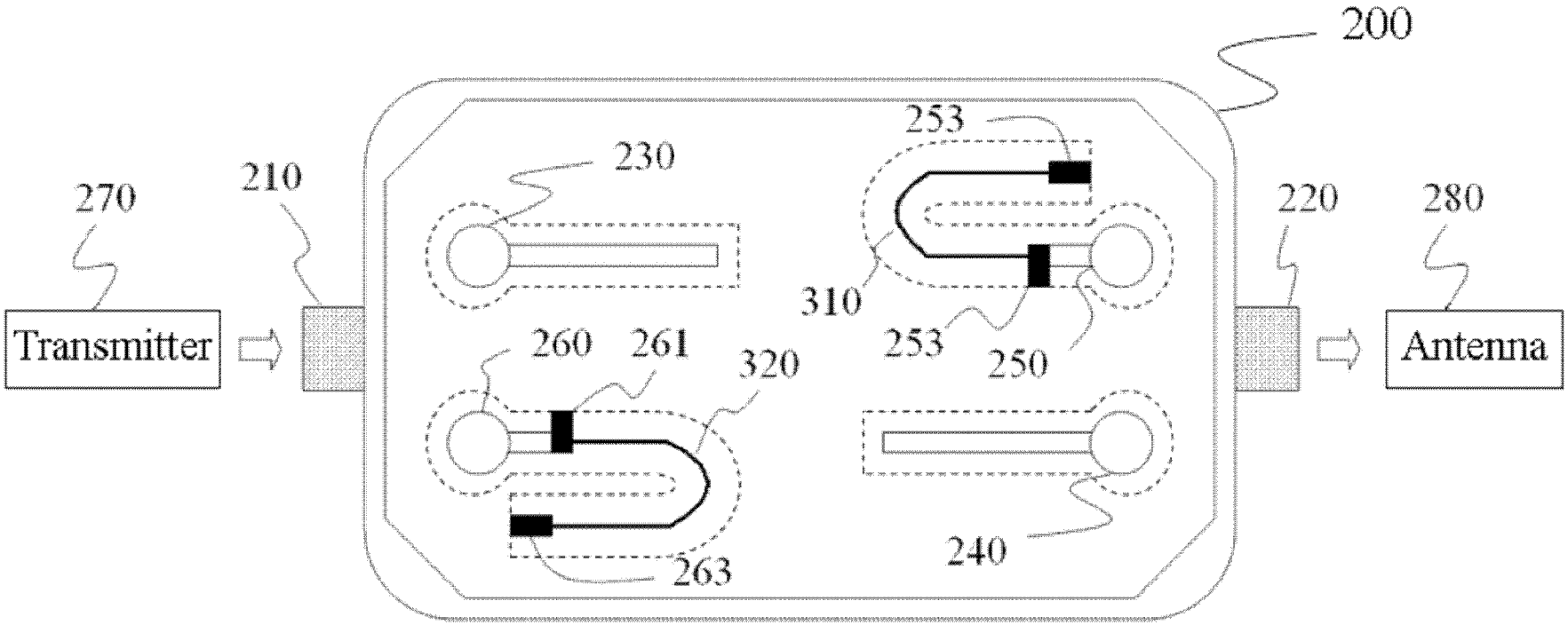
FIG. 1 shows a schematic view of an embodiment of a bi-directional coupler in accordance with the present disclosure.

FIG. 1 shows a schematic view of an embodiment of a bi-directional coupler 200 in accordance with the present disclosure. The bi-directional 200 provides four communication ports, comprising an input port 210, an output port 220, a coupled port 230 and an isolated port 240. In an embodiment, the bi-directional coupler 200 further provides two improved terminal circuits 250 and 260. The improved terminal circuit 250 comprises terminal resistors 251 and 253 and a transmission line 310 connecting the terminal resistors 251 and 253, wherein the terminal resistors 251 and 253 have substantially the same resistance value and each of them connects to a ground. The improved terminal circuit 260 comprises terminal resistors 261 and 263 and a transmission line 320 connecting the terminal resistors 261 and 263, where the terminal resistors 261 and 263 have substantially the same resistance value and each of them connects to a ground.

Figure 2:
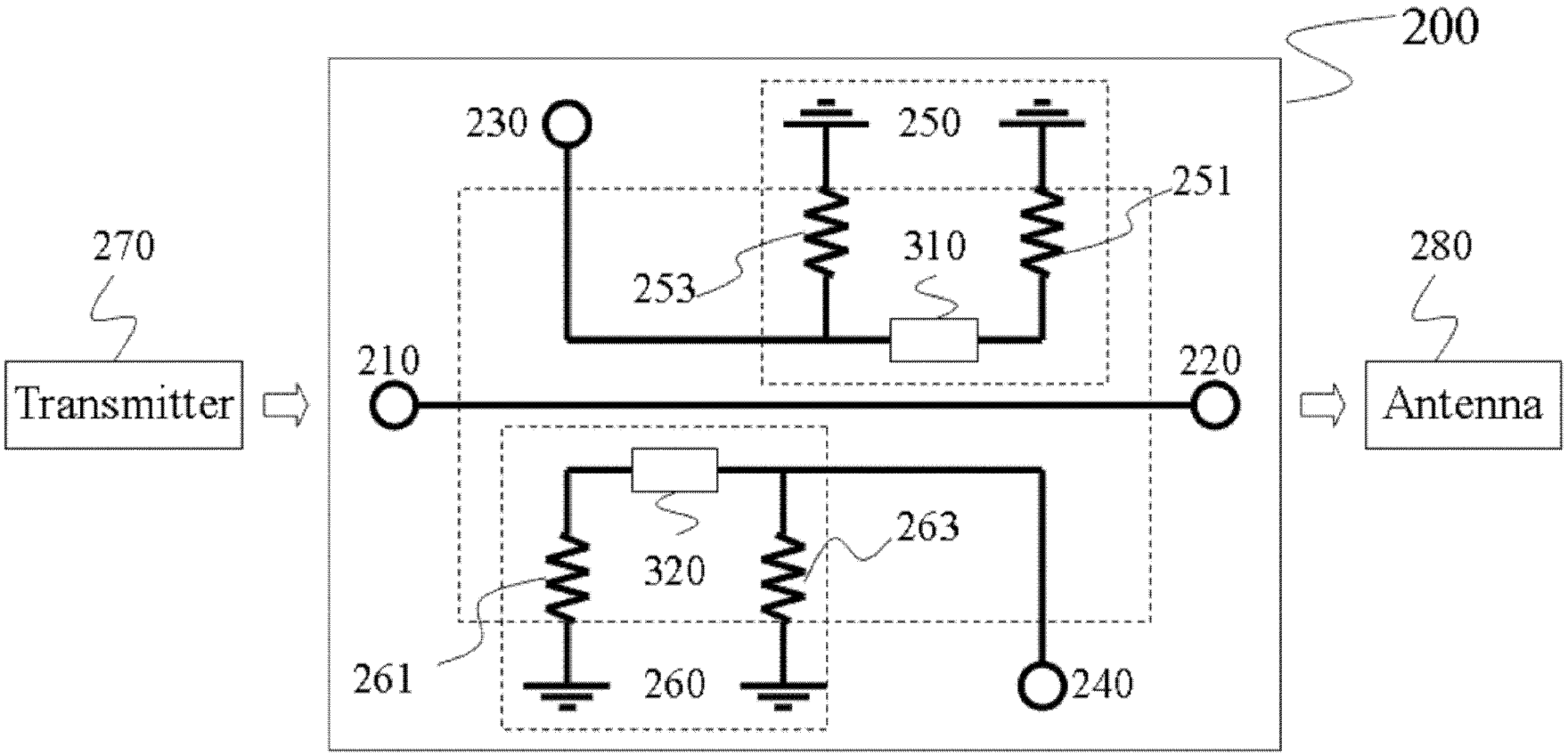
FIG. 2 shows a schematic view of an equivalent circuit of the bi-directional coupler shown in FIG. 2 in accordance with the present disclosure.
Figure 4:
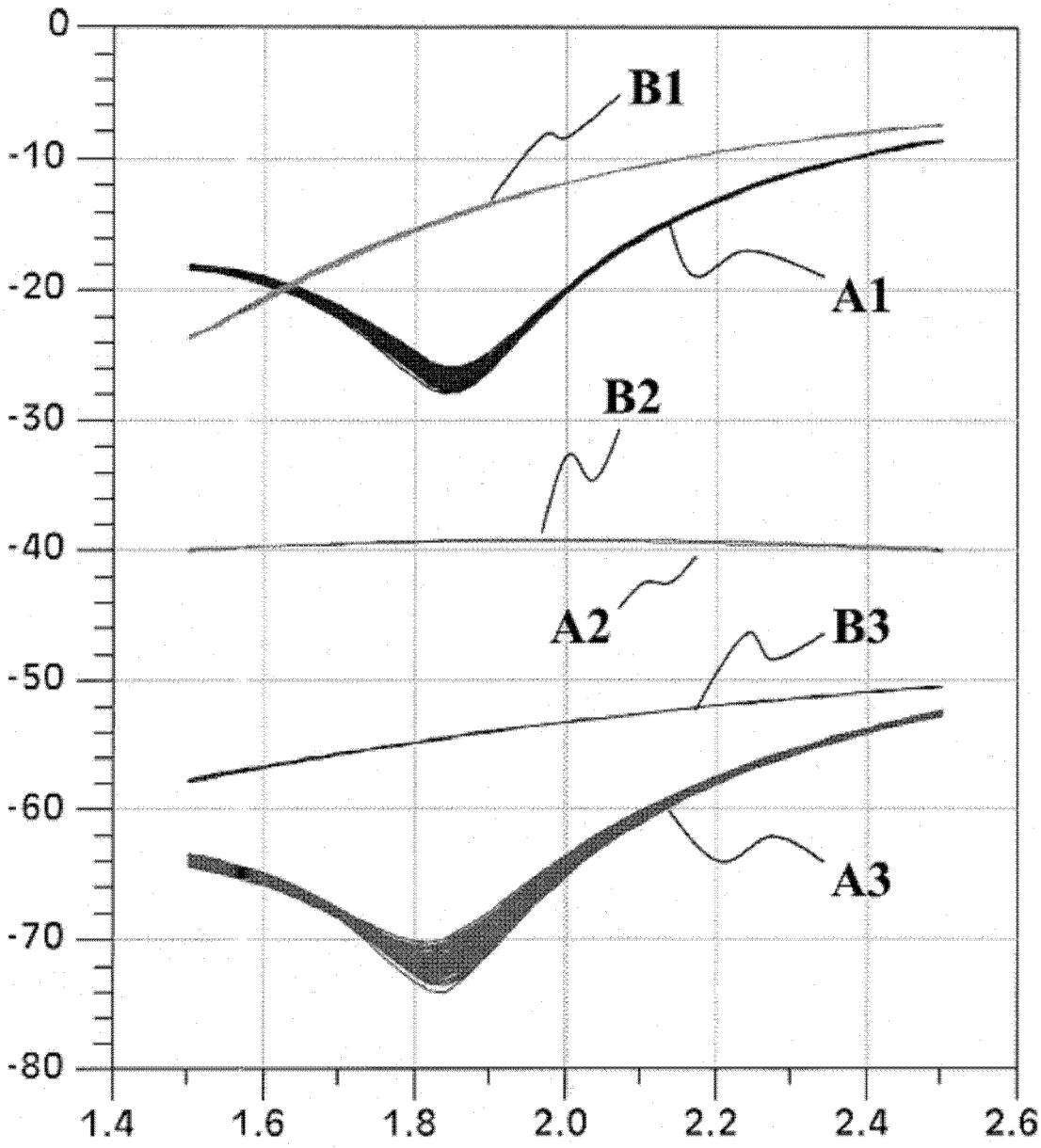
FIG. 4 shows a schematic view of a verification result, using the Monte Carlo Simulation method, for return loss and isolation of an embodiment of a bi-directional coupler in accordance with the present disclosure.
Figure 5:
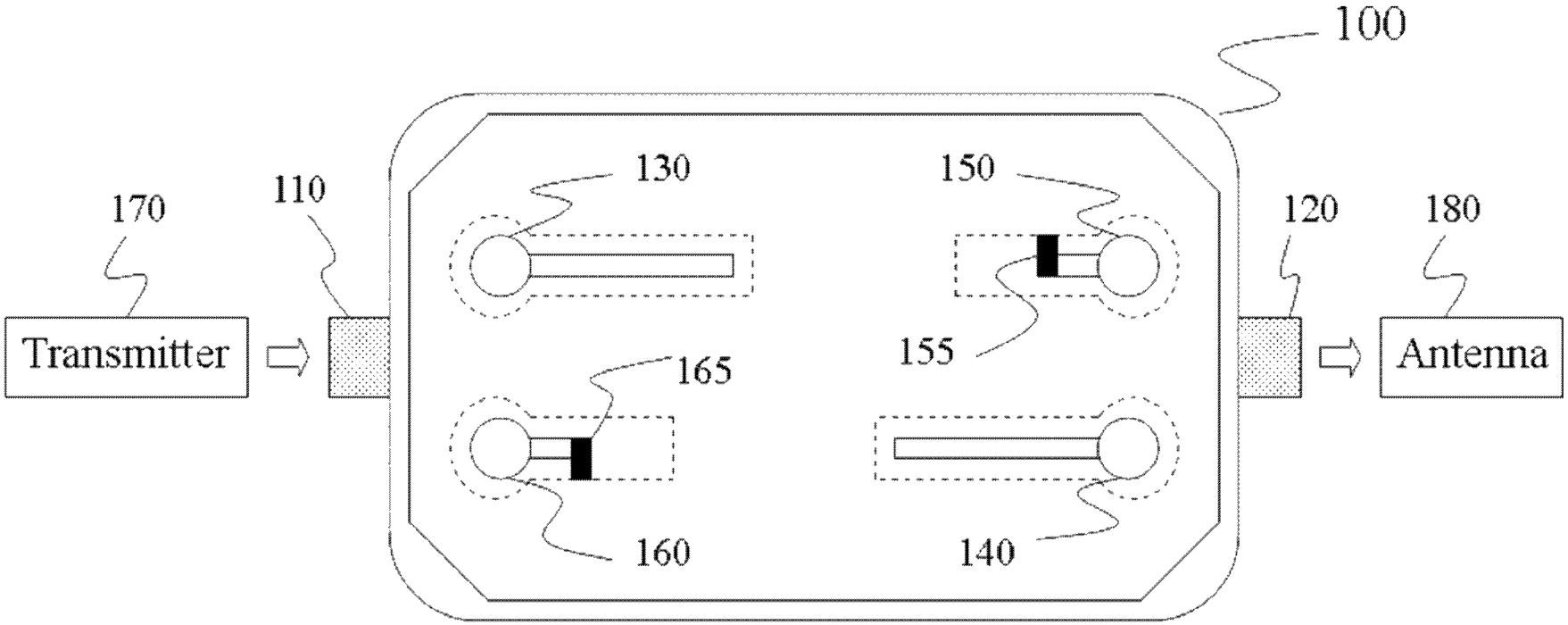
FIG. 5 shows a schematic view of one example of a bi-directional coupler of the prior art.
Figure 6:
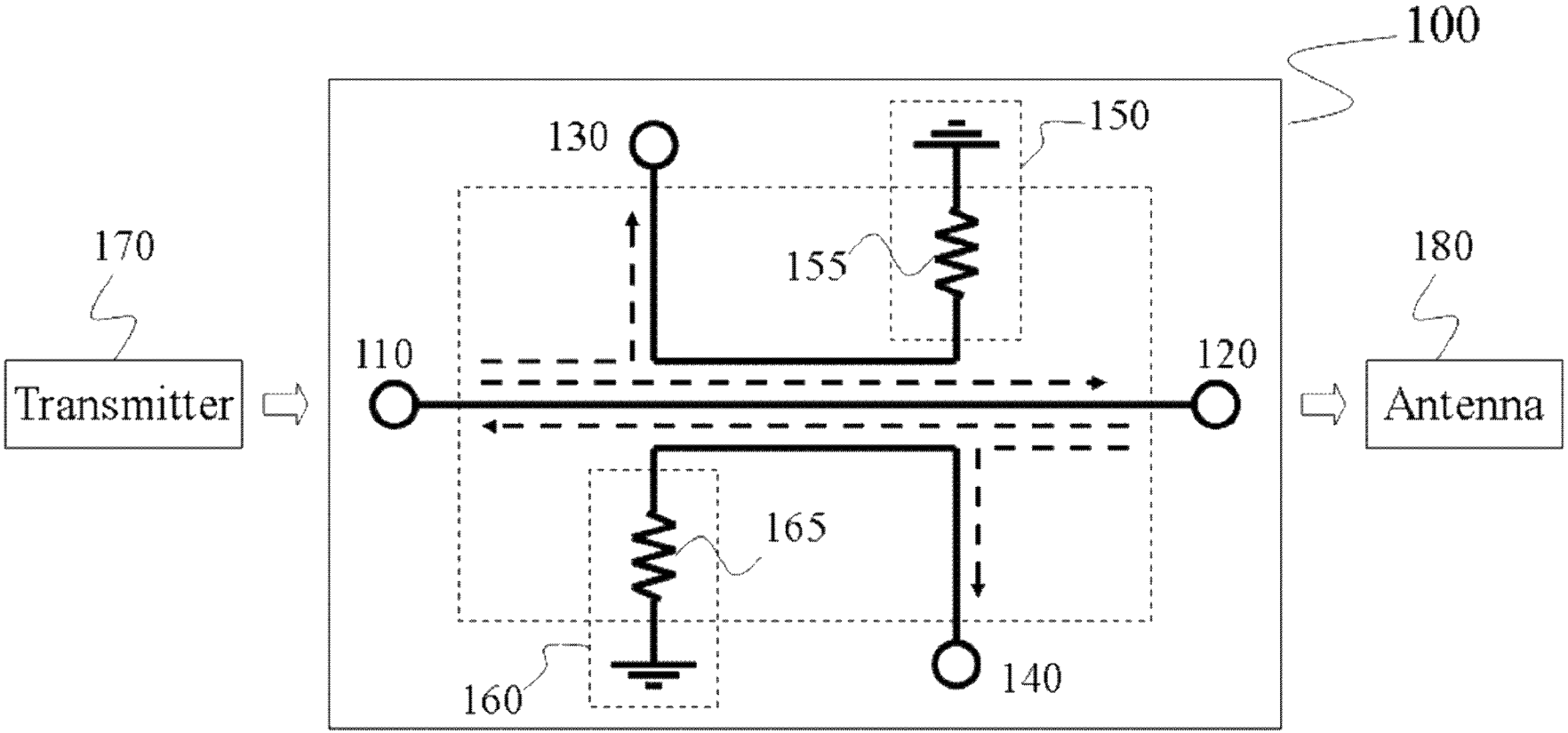
FIG. 6 shows a schematic view of an equivalent circuit of the bi-directional coupler shown in FIG. 5.

FIG. 2 shows a schematic view of an equivalent circuit of the bi-directional coupler 200 shown in FIG. 1 in accordance with the present disclosure. As described, an embodiment of the bi-directional coupler uses improved terminal circuits to reduce return loss and enhance isolation as well as achieve high directivity. Referring to FIGS. 4 and 5, the improved terminal circuit 250 includes the terminal resistors 251 and 253, which are connected with the transmission line 310. Similarly, the improved terminal circuit 260 includes the terminal resistors 261 and 263, which are connected with the transmission line 320.

Figure 3:
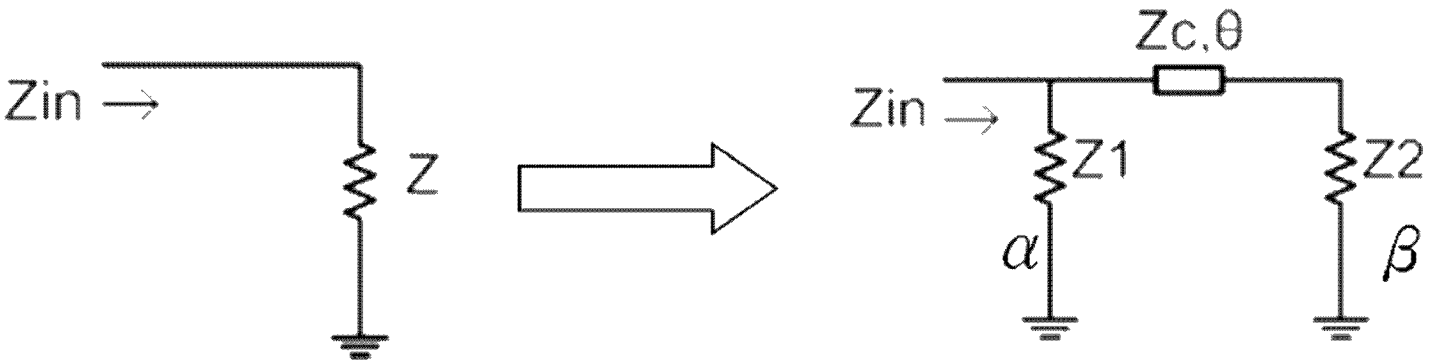
FIG. 3 shows a schematic view of an improved terminal circuit provides two terminal resistors which are connected with a transmission line, compared with a traditional terminal circuit providing a single terminal resistor.

Referring to FIG. 3, compared with a traditional terminal circuit providing a single terminal resistor, an improved terminal circuit provides two terminal resistors, which are connected with a transmission line, where resistance values of both are substantially the same. An impedance Zin (i.e. an input resistance value) of the terminal circuit is calculated using the following equation:

$$Zin = Zc\frac{(\beta + j\tan\theta)}{(\alpha + \beta) + j(\alpha\beta + 1)\tan\theta},$$

where Zc represents a characteristic impedance of the transmission line (e.g. 100Ω), α represents a ratio of the resistance vale Z1 of one terminal resistor and the resistance value Zc, β represents a ratio of the resistance vale Z2 of the other terminal resistor and the resistance value Zc, θ represents a length of the transmission line (e.g. λ/2), and j represents $\sqrt{-1}$.

The efficiency of an embodiment of the bi-directional coupler using the improved terminal circuits is verified using a Monte Carlo Simulation method. Resistor-related parameters and transmission-line-related parameters are preset. Regarding resistor-related parameters, the "Tolerance of Resistor" is set as 2% and the "Line Width Variation" is set as 0.5 picofarad (pF). Regarding the transmission-line-related parameters, the "Substrate Thickness Variation" is set as 2%, the "Line Width Variation" is set as 2%, the "Metal Thickness Variation" is set as 2%, and the "Dielectric Constant Variation" is set as 2%.

FIG. 4 shows a schematic view of a verification result, using the Monte Carlo Simulation method, for return loss and isolation of an embodiment of a bi-directional coupler in accordance with the present disclosure. As illustrated, B1, B2 and B3 respectively represent return loss, coupled energy and isolation for a bi-directional coupler using a traditional terminal circuit, while A1, A2 and A3 respectively represent return loss, coupled energy and isolation for a bi-directional coupler using an improved terminal circuit of the present disclosure. It can be seen that the coupled energy for the improved terminal circuit is equivalent to that of the traditional terminal circuit. By contrast, the return loss has improvement in 5~10 dB and the isolation has improvement in 10~15 dB.

In conclusion, the return loss and isolation of an embodiment of the bi-directional coupler are maximized by using improved terminal circuits and high directivity can be achieved. In other words, an embodiment of the bi-directional coupler uses an improved terminal circuit providing two terminal resistors which are separated by a transmission for replacing a traditional terminal circuit providing a single terminal resistor. Thus, resistance tolerance influence caused by manufacturing processes and temperature variations and parasitic influence from parasitic capacitors is minimized, thereby enhancing accuracy of the terminal circuits and achieving high directivity of the bi-directional coupler.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A terminal circuit, comprising:

a transmission line comprising a first end and a second end;

a first resistor connecting the first end and a first ground; and a second resistor connecting the second end and a second ground;

wherein a resistance value of the first resistor is substantially identical to that of the second resistor;

wherein the terminal circuit is structured and arrange to reduce return loss for a signal passing the terminal circuit, and enhance isolation for the first and second resistors, wherein a length of the transmission line is equal to half of a wavelength (λ) of the signal.

2. A bi-directional coupler, comprising two terminal circuits, each of the terminal circuits comprising:

a transmission line comprising a first end and a second end;

a first resistor connecting the first end and a first ground; and a second resistor connecting the second end and a second ground;

wherein a resistance value of the first resistor is substantially identical to that of the second resistor;

wherein the terminal circuit is structured and arrange to reduce return loss for a signal passing the terminal circuit, and enhance isolation for the first and second resistors, wherein a length of the transmission line is equal to half of a wavelength (λ) of the signal.

* * * * *